US008857016B2

(12) United States Patent
Vantrease

(10) Patent No.: US 8,857,016 B2
(45) Date of Patent: Oct. 14, 2014

(54) HINGE ASSEMBLY

(75) Inventor: Steven B. Vantrease, Ann Arbor, MI (US)

(73) Assignee: Toyota Motor Engineering & Manufacturing North America Inc., Erlanger, KY (US)

( * ) Notice: Subject to any disclaimer, the term of this patent is extended or adjusted under 35 U.S.C. 154(b) by 52 days.

(21) Appl. No.: 13/429,718

(22) Filed: Mar. 26, 2012

(65) Prior Publication Data

US 2013/0247331 A1 Sep. 26, 2013

(51) Int. Cl.
*E05D 11/08* (2006.01)

(52) U.S. Cl.
CPC ..... *E05D 11/08* (2013.01); *E05D 11/087* (2013.01); *E05Y 2900/548* (2013.01)
USPC ..... 16/337

(58) Field of Classification Search
CPC ..... E05D 11/087; E05D 11/08; E05D 11/06; E05Y 2900/548
USPC ..... 16/337, 319, 342; 296/76, 146.11, 56, 296/146.8
See application file for complete search history.

(56) References Cited

U.S. PATENT DOCUMENTS

| | | | | |
|---|---|---|---|---|
| 2,553,185 | A | 5/1951 | Gessler | |
| 3,239,874 | A | 3/1966 | Sperzel | |
| 4,776,626 | A | 10/1988 | Seyler | |
| 6,349,449 | B1 | 2/2002 | Kuehl | |
| 7,076,836 | B1 * | 7/2006 | Butka | 16/342 |
| 7,636,984 | B2 * | 12/2009 | Oh | 16/374 |
| 7,669,286 | B2 * | 3/2010 | Lu et al. | 16/340 |
| 7,815,241 | B2 * | 10/2010 | Renke et al. | 16/375 |
| 8,074,322 | B2 * | 12/2011 | Wang et al. | 16/342 |
| 2008/0178427 | A1 | 7/2008 | Chen | |
| 2010/0269296 | A1 * | 10/2010 | Lin | 16/342 |
| 2011/0235248 | A1 * | 9/2011 | Huang et al. | 361/679.01 |

* cited by examiner

*Primary Examiner* — Jeffrey O Brien
(74) *Attorney, Agent, or Firm* — Dinsmore & Shohl LLP

(57) ABSTRACT

A hinge assembly for a trunk lid of an automotive vehicle. The hinge assembly includes a mounting plate secured to the vehicle and a hinge arm having first and second ends. The first end of the connecting arm is mounted to the mounting plate such that the second end of the hinge arm is pivotally movable between a lowered position and a fully raised position. A friction plate is provided adjacent to the mounting plate and hinge arm and includes a portion biased into contact with the hinge arm. The contact between the friction plate and the hinge arm provides frictional resistance to movement of the hinge arm between the lowered position and the fully raised position.

20 Claims, 3 Drawing Sheets

HINGE ASSEMBLY

BACKGROUND

1. Field of the Invention

The present invention generally relates to a hinge assembly. More specifically, the invention relates to a hinge assembly in an automotive vehicle that is used to secure a trunk lid to the vehicle.

2. Description of Related Art

A wide variety of hinges have been constructed to facilitate the opening and closing of the trunk lid of an automotive vehicle. Generally, these hinges have been simplistically constructed with bushing-type features that dampen the opening and closing of the trunk lid. In the alternative, hinges have been overly complex and expensive in the mechanisms utilized to provide the desired amount of resistance to opening and closing of the trunk lid.

When opening or closing a trunk lid, a certain amount of resistance to the opening and closing is perceived by the operator as representing a luxurious or high-quality feel. Such a feel lends itself to a positive perception of the quality of the automotive vehicle itself.

SUMMARY

In satisfying the above and overcoming various drawbacks and other limitations of the known technology, a hinge assembly, according to the principles of the present invention, is provided whereby an enhanced resistive feel is perceived by the operator during the opening and closing of the trunk lid for an automotive vehicle.

In one aspect of the present invention, a hinge assembly for a trunk lid of an automotive vehicle is provided comprising a mounting plate configured to be secured to a body portion of the vehicle; a hinge arm having a first end connected to the mounting plate for movement relative to the mounting plate and a closed position, an opened position and intermediate positions between the closed and opened positions, the hinge arm having a second end configured for being secured to the trunk lid of the vehicle such that the trunk lid is movable between closed and opened positions with movement of the hinge arm; a pivot connection provided between the first end of the hinge arm and the mounting plate, wherein the pivot connection provides a first resistance to pivotal movement of the connecting arm between the closed position and the opened position; and a friction plate having a mounting portion and an engagement portion, the mounting portion configured to be mounted to the vehicle and the engagement portion oriented at an angle relative to the mounting portion and being biased into engagement with the hinge arm, the hinge arm engaging the engagement portion during movement of the hinge arm from the closed position to the opened position, engagement of the engagement portion with the hinge arm providing a second resistance to pivotal movement of the hinge arm between the closed position and the opened position.

In another aspect of the invention, the second resistance remains substantially the same during movement of the connecting arm from the closed position to the opened position.

In another aspect of the invention, the engagement portion contacts the hinge arm at a substantially constant position on the hinge arm during movement of the hinge arm from the closed position to the opened position.

In a further aspect of the invention, the engagement portion includes an engagement rib contacting the hinge arm.

In yet another aspect of the invention, the engagement rib is the only part of the engagement portion contacting the hinge arm.

In still another aspect of the invention, the engagement rib projects from a surface of the engagement portion in a direction toward the hinge arm.

In a further aspect of the invention, the engagement rib defines a contact surface, the contact surface contacting the hinge arm during movement of the hinge arm from the closed position to the opened position.

In an additional aspect of the invention, the contact surface is a planar surface.

In another aspect of the invention, the planar surface is generally in surface to surface contact with the connecting arm.

In still another aspect of the invention, the engagement rib extends along an arcuate pathway.

In yet another aspect of the invention, the arcuate pathway defines a radius of curvature.

In a further aspect of the invention, the friction plate is formed of a plastic material, such as polyoxymethylene (POM).

Further objects, features and advantages of this invention will become readily apparent to persons skilled in the art after a review of the following description, with reference to the drawings and claims that are appended to and form a part of this specification.

DETAILED DESCRIPTION

Figure 1:
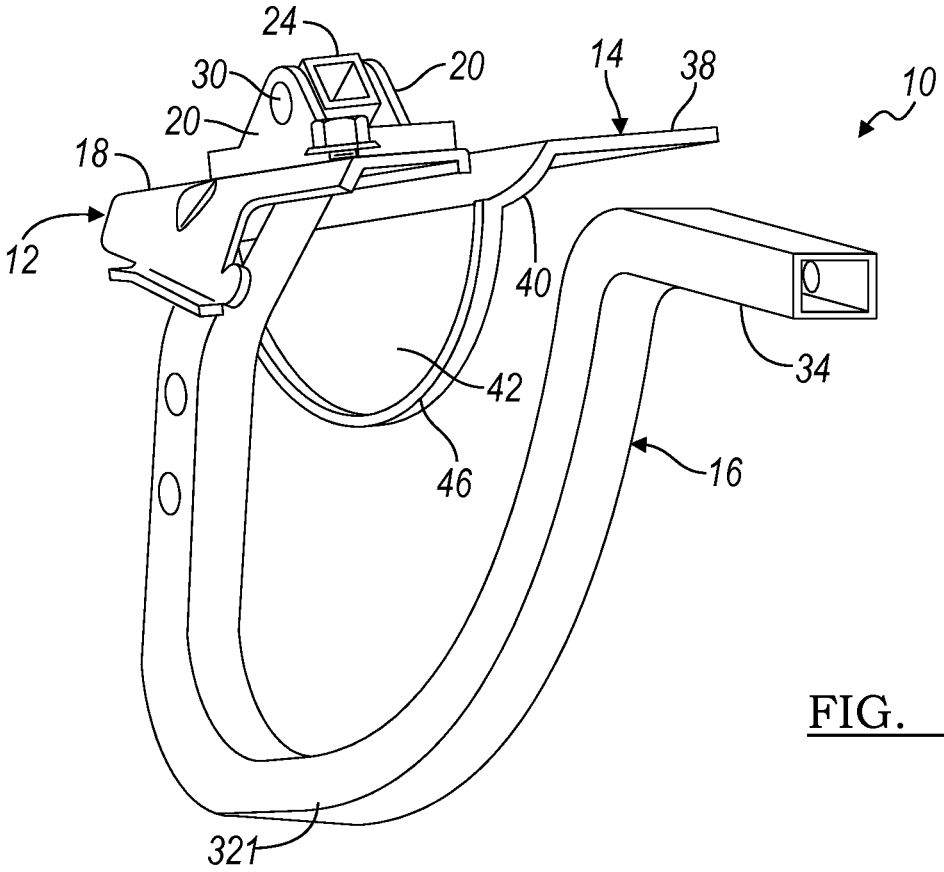
FIG. 1 is a perspective view of a hinge assembly embodying the principles of the present invention.
Figure 2:
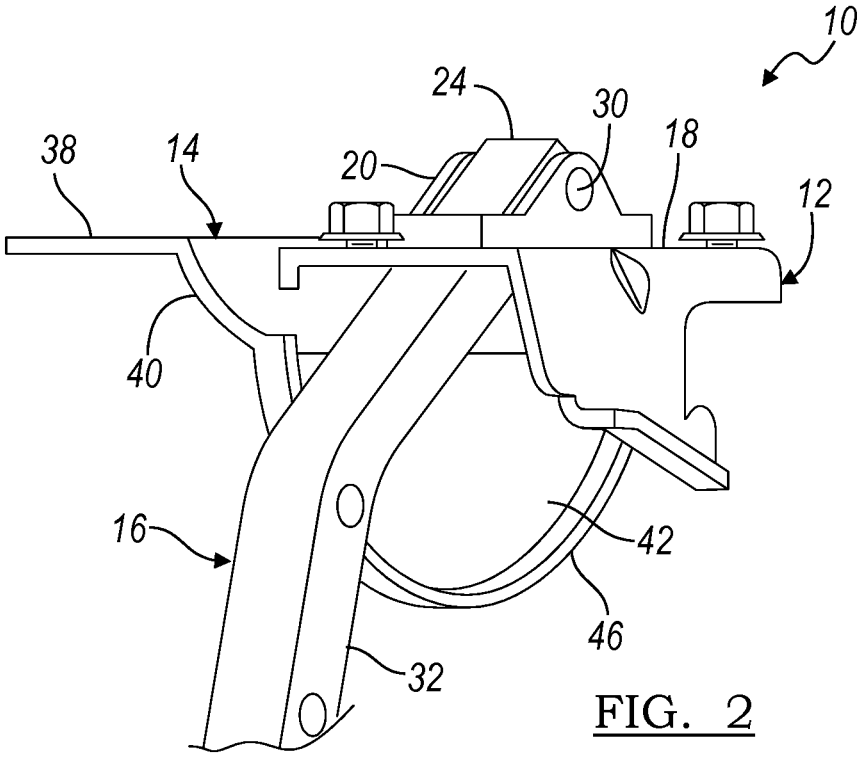
FIG. 2 is a partial view of the hinge assembly when viewed from the opposing direction in FIG. 1.

Referring now to the drawings, a hinge assembly embodying the principles of the present invention is illustrated therein and designated at 10. As its primary components, the hinge assembly 10 includes a mounting bracket 12, a friction plate 14 and a hinge arm 16.

The mounting bracket 12 includes a mounting flange 18 that is configured to be mounted to a body portion of an automotive vehicle (not shown). The mounting flange 18 is configured to be secured to the body portion of the vehicle through various well-known means, including bolting, screwing or welding thereto. The mounting bracket 12 also includes a pair of opposed pivot bases 20 between which is defined an opening 22. The pivot bases 20 may be formed in any desired shape and are illustrated as having a generally triangular shape extending at 90° relative to the mounting flange 18.

Received within the opening 22 is a first end 24 of the hinge arm 16. The first end 24 is mounted to the mounting bracket 12 so as to be pivotally movable with respect thereto over a range of motion of at least 90°. In order to effectuate the mounting of the hinge arm 16 to the mounting bracket 12, apertures 26 are coaxially defined in each of the pivot bases 20 and a corresponding aperture 28, coaxial with the apertures 26, is defined generally laterally through the first end 24 of the hinge arm 16. Press fit and extending through the apertures 26 of the pivot bases 20 and the aperture 28 of the first end 24 is an axle or pivot pin 30. The pivot pin 30 may extend from one pivot base 20 through the first end 24 to the other pivot-based 20. Alternatively, a pivot pin 30 may be provided so as to extend through each of the apertures 26 of the pivot bases 20 and through the apertures 28 in the first ends 24 of the hinge arm 16. While illustrated and thus far described as being a simple pivot pin 30, the pivot pin 30 may be provided as a bearing or bushing to facilitate the relative pivotal movement of the hinge arm 16 to the mounting bracket 12. Accordingly, the pivot pin 30 is intended to encompass these alternate constructions. Also, while the pivot pin 30 is disclosed as being press fit through the apertures 26, 28, the pivot pin 30 may be positively retained by the formation of a head (not shown) on one end of the pivot pin 30 and utilization of a snap ring (not shown) or other retention mechanism on the opposing end of the pivot pin 30.

Figure 3:
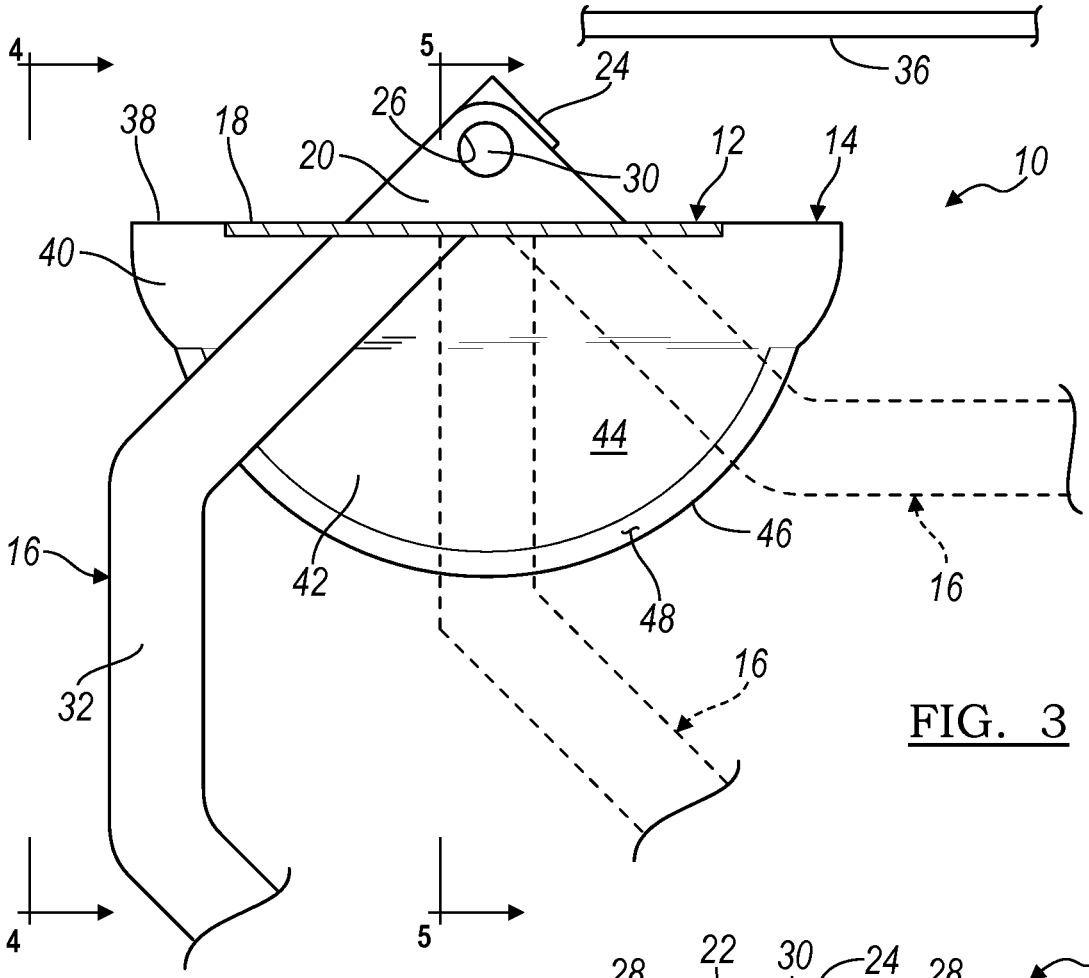
FIG. 3 is a schematic view of the hinge assembly seen in FIG. 1 and illustrates the hinge arm and three alternate positions.

When mounted to the mounting bracket 12, the hinge arm 16 can be pivotally moved between the fully closed position, generally designated by the solid line depiction of the hinge arm 16 in FIG. 3, and a fully opened position, which is generally designated in phantom and toward the right side of FIG. 3. Between these two positions, the hinge arm 16 can assume a plurality of intermediate positions, only one of which is illustrated in phantom in FIG. 3.

As perhaps is best seen in FIG. 1, the hinge arm 16 extends from its first end 24 by way of a reversely bent portion 32 until terminating in a trunk end 34, which is configured for mounting to the trunk lid 36 of the automotive vehicle. Since the trunk end 34 of the hinge arm 16 can be mounted to the trunk lid 36 through a wide variety of mounting configurations, the trunk end 34 is merely depicted as generally having a straight configuration and a mounting bore for enabling attachment to the trunk lid 36.

When the trunk lid 36 is closed, the hinge arm 16 is positioned in its fully closed position, seen on the left-hand side of FIG. 3. During opening of the trunk lid 36, the hinge arm 16 is pivoted with respect to the mounting bracket 12 and moves through the intermediate position (generally seen in the center of FIG. 3) to the fully open position, seen on the right-hand side of FIG. 3. To assist in the opening of the trunk lid 36 and to retain the trunk lid 36 in its open position, a spring or pneumatic lift assist (not shown) may also be provided between the body of the vehicle and the trunk lid 36.

A flange assembly having a significant amount of frictional resistance to opening is generally perceived by the operator as having a luxurious feel. This resistance to opening can be provided by the interaction of the pivot pin 30 with the pivot bases 20 and the hinge arm 16. However, after a period of cycling the trunk lid 36, the resistance to opening provided by this interaction decreases and the luxurious feel diminishes accordingly.

In accordance with the principles of the present invention, the friction plate 14 is provided adjacent to the hinge arm 16 and biased into contact with a side surface 37 of the hinge arm 16. As the hinge arm 16 is moved from its fully closed position to its fully open position, the side surface 37 of the hinge arm 16 remains in contact with a portion of the friction plate 14 thereby providing a resistance to opening that is sufficient to instill the desired luxurious feel.

Figure 6:
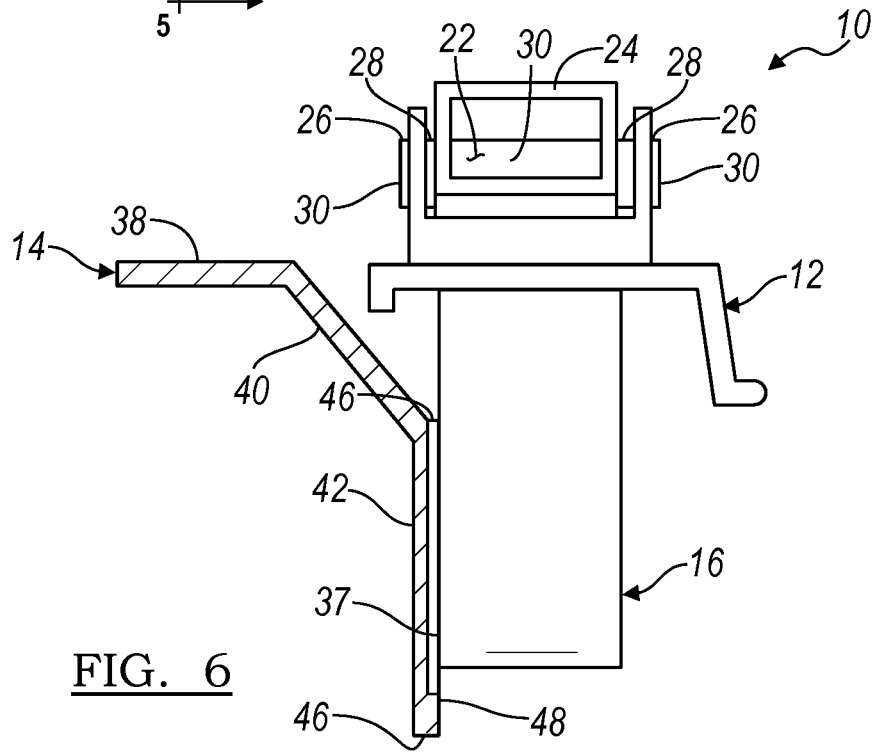
FIG. 6 is a view, generally taken along line 5-5 in FIG. 3, showing the hinge arm in a substantially open position.
Figure 4:
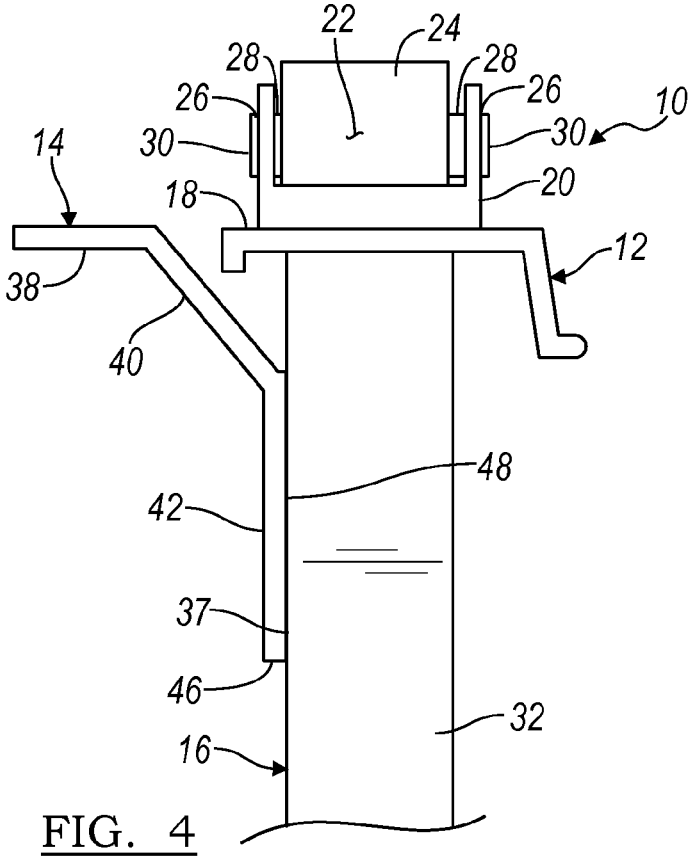
FIG. 4 is a view, generally taken along line 4-4 in FIG. 3, showing the hinge arm in the fully closed position.
Figure 5:
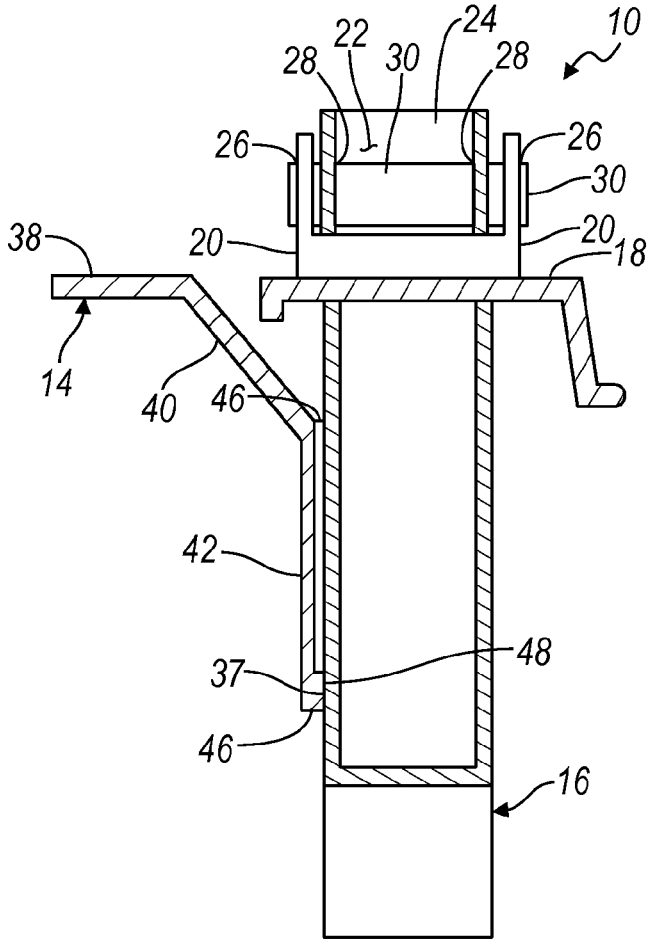
FIG. 5 is a view, generally taken along line 5-5 in FIG. 3, showing the hinge arm in an intermediate position.

In achieving the above, the friction plate 14 includes a mounting portion 38, a transition section 40 and engagement plate 42. The mounting portion 38 is configured to be secured to a body or other portion (not shown) of the automotive vehicle. Regardless of the portion of the vehicle to which the mounting portion 30 is secured, this securement is done such that the engagement plate 42 is positioned in contact with the hinge arm 16. The positioning of the engagement plate 42 is the function of the transition section 40, whose shape and orientation relative to the mounting portion 38 and the engagement plate 42 is determined by the specific design implementation of the vehicle. As seen in FIGS. 4-6, the transition section 40 is an angled section positioned between the mounting portion 38 and the engagement plate 42, the latter two portions being disposed generally perpendicularly to one another in this particular embodiment.

The engagement plate 42 is oriented so as to be generally parallel with the side surface 37 of the hinge arm 16 or a plane defined by the adjacent side of the hinge arm 16. In its free position (the position assumed by the engagement plate 42 if mounted to the vehicle without the hinge arm 16 also being mounted to the vehicle), the engagement plate 42 may be presented at an angle beyond that illustrated in the figures. In this way, when the hinge arm 16 is also mounted to the vehicle, the engagement plate 42 is biased into engagement with the side of the hinge arm 16 so as to provide the desired amount of interference in resistance.

The surface 44 of the engagement plate 42 opposing the side surface 37 of the hinge arm 16 may be provided as a flat planar surface. Alternatively, and as illustrated in the figures, the engagement plate 42 may optionally be provided with an engagement rib 46. The engagement rib 46 defines a projection on the surface 44 of the engagement plate 42 and a surface 48 of the engagement rib 46 frictionally engages the side surface 37 of the hinge arm 16.

As seen in FIG. 3, the engagement rib 46 extends in an arcuate fashion along the perimeter of the engagement plate 42. The surface 48 of the engagement rib 36 in actual contact with the side surface 37 of the hinge arm 16 may be a flat surface or a curved surface. A flat surface provides for enhanced frictional contact between the engagement rib 46 and the hinge arm 16. Alternatively, the engagement rib 46 may be provided with a surface treatment or an overlying layer that increases the frictional resistance when engaged with the side surface 37 of the hinge arm 16. Preferably, the engagement rib 46 exhibits a radius of curvature that generally corresponds with the radius of curvature of a point located on the side surface 37 such that the engagement rib 46 generally contacts the side surface 37 at the same location as the hinge arm 16 is moved between its closed and open positions. In the alternative configuration, these radii of curvature do not correspond and the point at which the engagement rib 46 contacts the side surface 37 varies along the length of the hinge arm 16 as the hinge arm pivotally rotates between its closed and open positions. In a further variation, the engagement rib 46 extends linearly across the engagement plate 42 and thereby contacts the side surface 37 at a varying location along the length of the hinge arm 16.

The friction plate 14 may be constructed from a variety of materials. A preferred material for the friction plate is a plastic material that generally has memory and a high wear resistance. One such material is polyoxymethylene (POM).

As a person skilled in the art will readily appreciate, the above description is meant as an illustration of implementation of the principles this invention. This description is not intended to limit the scope or application of the invention since the invention is susceptible to modification, variation and change, without departing from the spirit of this invention, as defined in the following claims.

The invention claimed is:

1. A hinge assembly for a trunk lid of an automotive vehicle, the hinge assembly comprising:

a mounting plate configured to be secured to a body portion of the vehicle;

a hinge arm having a first end connected to the mounting plate for movement relative to the mounting plate between a closed position, an opened position and intermediate positions between the closed and opened positions, the hinge arm having a second end configured for being secured to the trunk lid of the vehicle such that the trunk lid is movable between a closed position and an opened position with movement of the hinge arm;

a pivot connection provided between the first end of the hinge arm and the mounting plate, wherein the pivot connection provides a first resistance to pivotal movement of the hinge arm between the closed position and the opened position; and a friction plate having a mounting portion and a planar engagement portion, the mounting portion configured to be mounted to the vehicle and the engagement portion oriented at an angle relative to the mounting portion and being biased into engagement with the hinge arm to define a point of contact, the hinge arm engaging the engagement portion during the full range of movement of the hinge arm from the closed position to the opened position and the point of contact defining an arc across the engagement portion during the full range of movement of the hinge arm from the closed position to the open position, engagement of the engagement portion with the hinge arm providing a second resistance to pivotal movement of the hinge arm during the full range of movement between the closed position and the opened position.

2. A hinge assembly according to claim 1, wherein the second resistance remains substantially the same during movement of the hinge arm from the closed position to the opened position.

3. A hinge assembly according to claim 1, wherein the engagement portion contacts the hinge arm at a constant position on the hinge arm during movement of the hinge arm from the closed position to the opened position.

4. A hinge assembly according to claim 1, wherein the engagement portion includes an engagement rib contacting the hinge arm.

5. A hinge assembly according to claim 4, wherein the engagement rib is the only part of the engagement portion contacting the hinge arm.

6. A hinge assembly according to claim 4, wherein the engagement rib projects from a surface of the engagement portion in a direction toward the hinge arm.

7. A hinge assembly according to claim 4, wherein the engagement rib defines a contact surface, the contact surface contacting the hinge arm during movement of the hinge arm from the closed position to the opened position.

8. A hinge assembly according to claim 7, wherein the contact surface is a planar surface.

9. A hinge assembly according to claim 8, wherein the planar surface is generally in surface to surface contact with the connecting arm.

10. A hinge assembly according to claim 4, wherein the engagement rib extends along an arcuate pathway.

11. A hinge assembly according to claim 10, wherein the arcuate pathway defines a radius of curvature.

12. A hinge assembly according to claim 1, wherein the friction plate is formed of a plastic material.

13. A hinge assembly according to claim 12, wherein the plastic material is polyoxymethylene.

14. A hinge assembly comprising:

a mounting plate configured to be secured to a fixed structure;

a hinge arm having a first end connected to the mounting plate for movement relative to the mounting plate between a first position, a second position and intermediate positions between the first and second positions, the hinge arm having a second end configured for being secured to the moveable structure, the moveable structure being movable between first and second positions with movement of the hinge arm;

a pivot connection provided between the first end of the hinge arm and the mounting plate, wherein the pivot connection provides a first resistance to pivotal movement of the hinge arm between the first position and the second position; and a friction plate having a mounting portion and a planar engagement portion, the mounting portion configured to be mounted to the fixed structure and the engagement portion oriented at an angle relative to the mounting portion and being biased into engagement with the hinge arm at a point of contact located between the first end and the second end of the hinge arm, the hinge arm engaging the engagement portion during the full range of movement of the hinge arm from the first position to the second position and the point of contact defining an arc during the full range of movement across the engagement portion, engagement of the engagement portion with the hinge arm providing a second resistance to pivotal movement of the hinge arm during the full range of movement between the first position and the second position.

15. A hinge assembly according to claim 14, wherein the engagement portion contacts the hinge arm at a constant position along the hinge arm during movement of the hinge arm from the first position to the second position.

16. A hinge assembly according to claim 14, wherein the engagement portion includes an engagement rib projecting from the engagement portion and contacting the hinge arm.

17. A hinge assembly according to claim 16, wherein the engagement rib defines a contact surface, the contact surface contacting the hinge arm during movement of the hinge arm.

18. A hinge assembly according to claim 17, wherein the contact surface is a planar surface.

19. A hinge assembly according to claim 18, wherein the planar surface is generally in surface to surface contact with the hinge arm.

20. A hinge assembly according to claim 16, wherein the engagement rib extends along a perimeter of the engagement portion.

* * * * *